US007175541B2

(12) United States Patent
Lo

(10) Patent No.: US 7,175,541 B2
(45) Date of Patent: Feb. 13, 2007

(54) GOLF CLUB HEAD

(75) Inventor: Lai-Fa Lo, Taoyuan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 265 days.

(21) Appl. No.: 10/894,063

(22) Filed: Jul. 20, 2004

(65) Prior Publication Data

US 2006/0019768 A1 Jan. 26, 2006

(51) Int. Cl.
*A63B 53/04* (2006.01)

(52) U.S. Cl. ..... 473/345; 473/346; 473/349; 473/335; 273/DIG. 14

(58) Field of Classification Search ..... 473/324–350; 273/DIG. 14
See application file for complete search history.

(56) References Cited

U.S. PATENT DOCUMENTS 4,021,047 A * 5/1977 Mader ..... 473/345
5,056,705 A * 10/1991 Wakita et al. ..... 228/176
5,337,670 A * 8/1994 Huang ..... 101/487
5,624,331 A * 4/1997 Lo et al. ..... 473/345
5,800,285 A * 9/1998 Thorne et al. ..... 473/324
5,967,904 A * 10/1999 Nagai et al. ..... 473/345
5,997,415 A * 12/1999 Wood ..... 473/346
7,008,332 B2 * 3/2006 Liou ..... 473/345
2001/0049310 A1 * 12/2001 Cheng et al. ..... 473/334
2006/0019769 A1 * 1/2006 Lo ..... 473/345

FOREIGN PATENT DOCUMENTS

JP 05-317465 * 12/1993
JP 2003-111874 A 4/2003

* cited by examiner

*Primary Examiner*—Sebastiano Passaniti
(74) *Attorney, Agent, or Firm*—Birch, Stewart, Kolasch and Birch, LLP

(57) ABSTRACT

A golf club head includes a body and at least one transparent cover. The body includes a striking face for striking golf balls and a hosel for coupling with a shaft. The body includes a crown in which at least one opening is defined. A perimeter delimiting the opening includes a stepped portion. The transparent cover is securely mounted to the opening of the crown. The transparent cover is made of a transparent material having a specific gravity smaller than 1.5 g/cm$^3$ for reducing a weight of the crown of the golf club head and for shifting a center of gravity of the golf club head downward and rearward.

19 Claims, 4 Drawing Sheets

GOLF CLUB HEAD

BACKGROUND OF THE INVENTION

1. Field of the Invention

The present invention relates to a golf club head. In particular, the present invention relates to a golf club head with a lower and more rear center of gravity.

2. Description of Related Art

Japanese Patent Publication No. 2003-111874 discloses a golf club head comprising a body with an opening defined in a crown portion thereof. Two carbon fiber plates are respectively bonded to inner and outer sides of the opening. The carbon fiber plates have a specific gravity of about 1.8 g/cm$^3$ and the body has a specific gravity of about 4.5 g/cm$^3$. By means of using the carbon fiber plates to replace a portion of the crown of the body, the center of gravity of the body is shifted downward and rearward for increasing the inertia moment and for improving the striking effect. Shift of the center of gravity is limited, as the specific gravity of the carbon fiber plates could not be reduced. Further, the color of the carbon fiber plates is black and thus fails to provide colorful appearances. The only option is to modify the appearance of the carbon fiber plates by baking finish.

OBJECTS OF THE INVENTION

An object of the present invention is to provide a golf club head including a body having reduced weight in a crown thereof to allow adjustment of a center of gravity in a wider range and to increase the inertia moment of the golf club head.

Another object of the present invention is to provide a golf club head with improved visual effect and added value.

SUMMARY OF THE INVENTION

In accordance with the present invention, a golf club head comprises a body and at least one transparent cover. The body includes a striking face for striking golf balls and a hosel for coupling with a shaft. The body includes a crown in which at least one opening is defined. A perimeter delimiting the opening includes a stepped portion. The transparent cover is securely mounted to the opening of the crown. The transparent cover is made of a transparent material having a specific gravity smaller than 1.5 g/cm$^3$ for reducing a weight of the crown of the golf club head and for shifting a center of gravity of the golf club head downward and rearward.

At least one chamber may be defined in a rear portion of a sole of the body for receiving at least one weight member.

The opening may extend from the crown toward a toe, a heel, and/or a sole of the body.

The transparent cover is made of crystalline or non-crystalline engineering plastic. Preferably, the transparent cover is made of a material selected from the group comprising polyetherimide (PEI), polyethersulfone (PES), polyphenylene sulfide (PPS), polyphthalamide (PPA), polyetherketone (PEK), and polyether ether ketone (PEEK).

In an embodiment of the invention, the body includes a compartment delimited by an inner wall, and a marking area is provided on the inner wall. The marking area is formed by ink printing, water jet engraving, mechanical engraving, laser engraving, sanding, sticking, or integral casting.

In another embodiment of the invention, the transparent cover includes an inner face, and a marking area is provided on the inner face of the transparent cover. The marking area is formed by ink printing, laser engraving, sanding, sticking, or integral molding injection.

In a further embodiment of the invention, an extension rib extending from the stepped portion. A marking area is provided on an outer face of the extension rib. The marking area is formed by ink printing, water jet engraving, mechanical engraving, laser engraving, sanding, sticking, or integral casting.

The transparent cover may have a desired color. Further, the transparent cover may be convex or concave to provide a magnifying or reducing effect for the marking.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
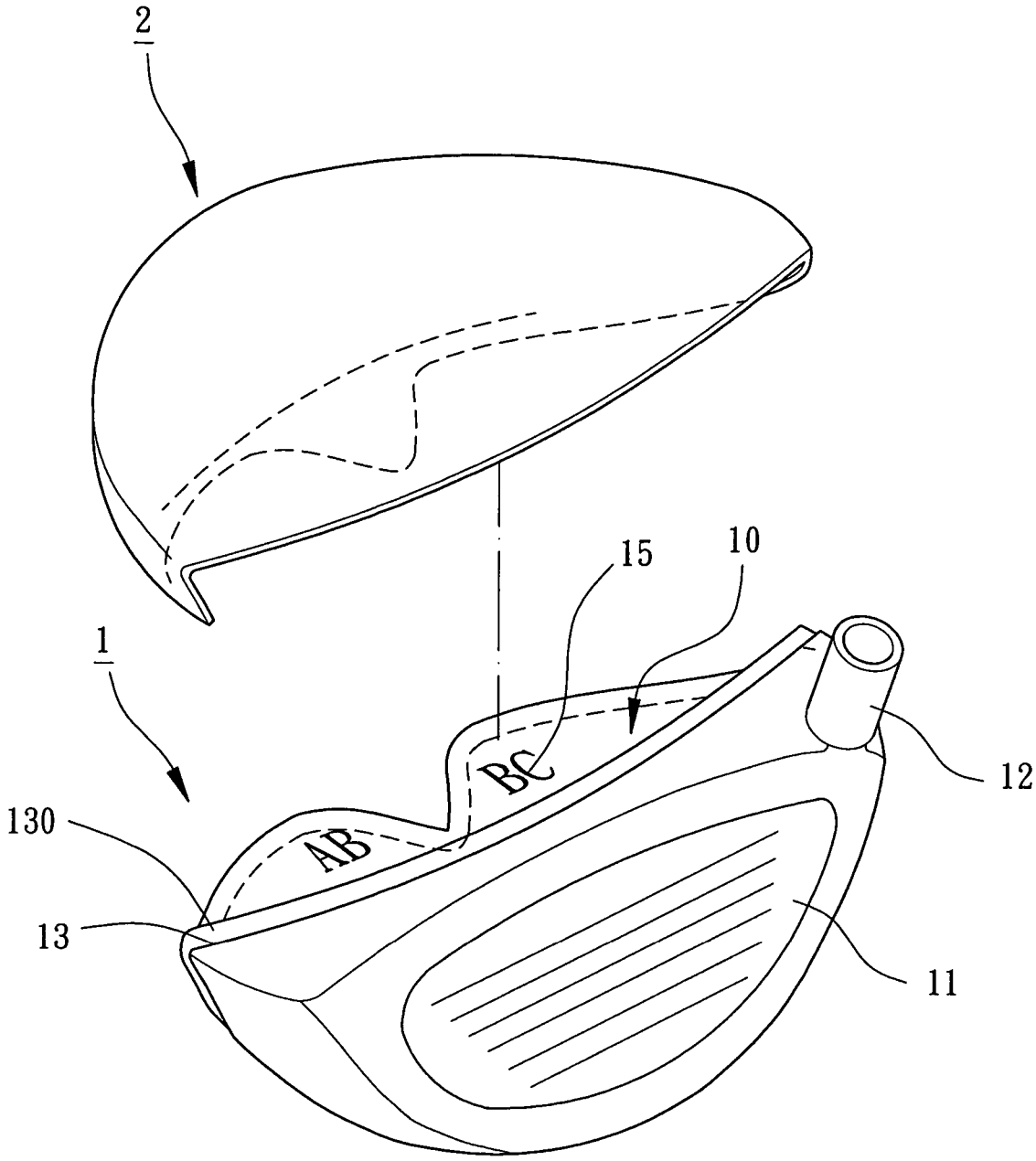
FIG. 1 is an exploded perspective view of a first embodiment of a golf club head in accordance with the present invention.

Referring to FIG. 1, a first embodiment of a golf club head in accordance with the present invention comprises a body 1 and at least one transparent cover 2. The body 1 is made of metal or alloy having a relatively large specific gravity greater than 3.5 g/cm$^3$, such as carbon steel, stainless steel, Fe—Mn—Al alloy, titanium alloy, etc. The body 1 can be obtained by means of integral formation or bonding several parts together. The body 1 includes a striking face 11, a hosel 12, and at least one opening 13. The striking face 11 is located on a front side of the body 1 for striking a golf ball. The hosel 12 is formed on a side of the body 1 for coupling with a shaft (not labeled). The opening 13 is defined in a crown of the body 1 and extends toward a toe, a heel, and a sole of the body 1. A perimeter delimiting the opening 13 includes a stepped portion 130 for coupling with the transparent cover 2.

The body 1 defines a compartment 10, with a marking area 15 being provided on an inner face of an inner wall of the body 1, such as a bottom portion of the inner wall of the body 1. Letters, patterns, symbols, trademarks, etc can be provided in the marking area 15 by ink printing, water jet engraving, mechanical engraving, laser engraving, sanding, sticking, or integral casting.

The transparent cover 2 is made of a light material having a specific gravity smaller than 1.5 g/cm$^3$. Preferably, the transparent cover 2 is made of a transparent plastic material such as crystalline or non-crystalline engineering plastic selected from the group comprising polyetherimide (PEI), polyethersulfone (PES), polyphenylene sulfide (PPS), polyphthalamide (PPA), polyetherketone (PEK), and poly ether ether ketone (PEEK). These polymeric resins have specific gravities between 1.45 and 0.9 k/cm$^3$ and may endure high temperature up to 150° C. The transparent cover 2 has a shape corresponding to that of the opening 13 of the body 1.

Still referring to FIG. 1, in assembly, the transparent cover 2 is bonded by adhesive such as epoxy to the stepped portion 130 of the opening 13. After assembly, due to significant difference in the specific gravity of the body 1 and the specific gravity of the transparent cover 2, the weight of the crown of the body 1 is significantly reduced. Thus, the center of gravity of the golf club head is shifted downward and rearward to a greater extent compared to the conventional design. The inertia moment of the golf club head is increased. Further, the transparent cover 2 is flexible and extends toward the heel, toe, and sole of the body 1, a flexible buffering space is provided between the crown, heel, toe, and sole of the body 1, thereby improving the resilient deforming capability of the body 1 and the striking face 11.

The transparency of the transparent cover 2 allows the user to see the marking area 15 in the body 1, providing a special seeing-through effect as well as added value. The transparent cover 2 may have a desired color. Further, the transparent cover 2 can be shaped as a convex lens or concave lens to provide a magnifying or reducing effect for the marking.

Figure 2:
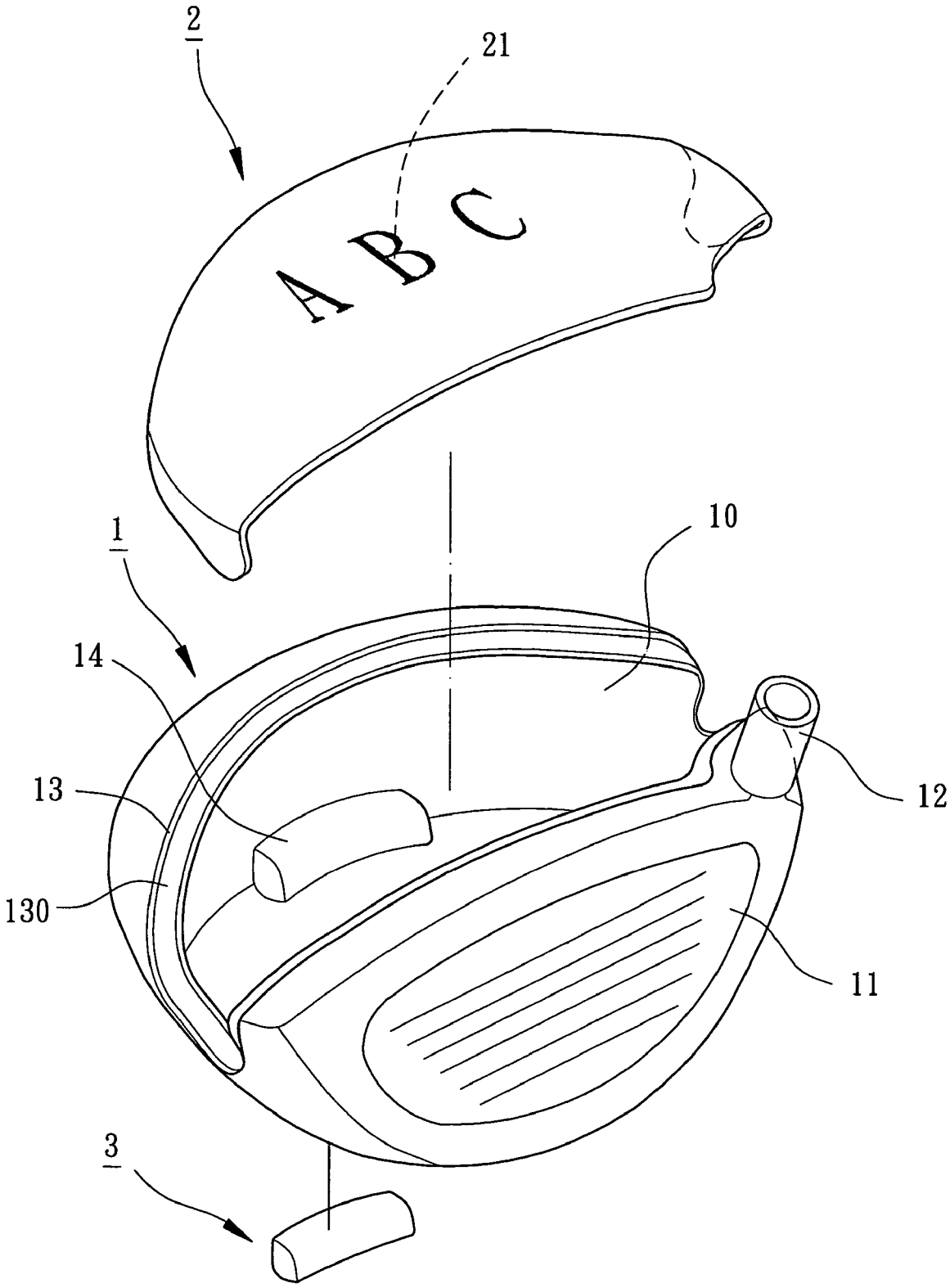
FIG. 2 is an exploded perspective view of a second embodiment of the golf club head in accordance with the present invention.

FIG. 2 illustrates a second embodiment of the golf club head in accordance with the present invention, wherein the transparent cover 2 includes a marking area 21 in an inner face thereof. Further, the transparent cover 2 only extends toward the heel and the toe of the body 1. Letters, patterns, symbols, trademarks, etc can be provided in the marking area 15 by ink printing, laser engraving, sanding, sticking, or integral molding injection. Alternatively, a marking with reflection effect or laser refraction effect can be provided. Finishing to the inner wall delimiting the compartment 10 of the body 1 can be simplified while increasing the shift of the center of gravity of the golf club head and providing an aesthetically pleasing effect. Further, the body 1 includes a chamber 14 in a rear portion of the sole for receiving a weight member 3. The weight member 3 is made of metal or alloy with a large specific gravity, such as W—Fe—Ni alloy. The weight member 3 is preferably mounted in the chamber 14 by means of force-fitting or welding. Thus, the weight member 3 further shifts the center of gravity of the golf club head downward.

Figure 3:
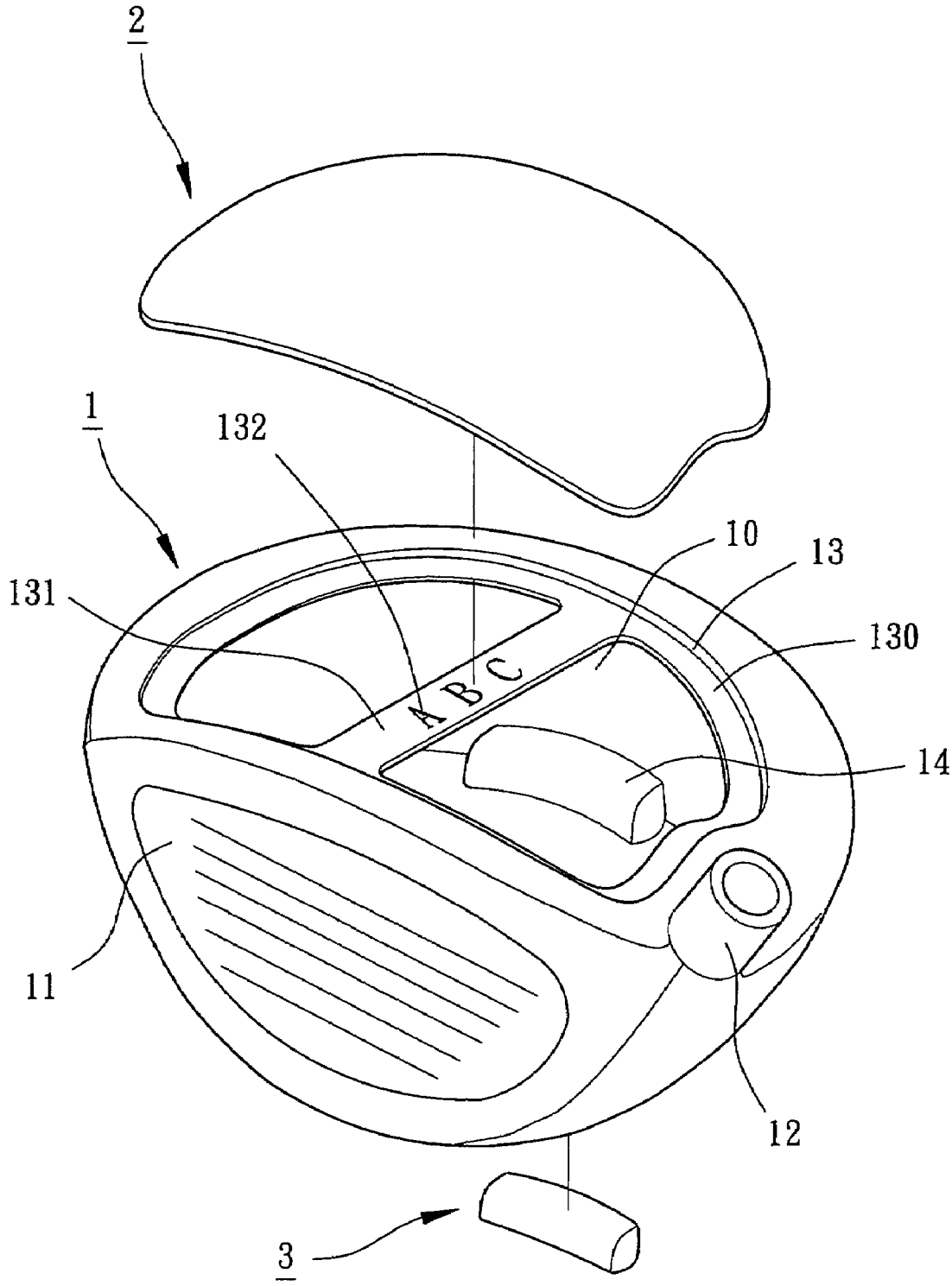
FIG. 3 is an exploded perspective view of a third embodiment of the golf club head in accordance with the present invention.

FIG. 3 illustrates a third embodiment of the golf club head in accordance with the present invention, wherein the stepped portion 130 of the opening 13 includes an extension rib 131 extending across two opposite sides of the stepped portion 130, with a marking area 132 being provided on an outer face of the extension rib 131. Letters, patterns, symbols, trademarks, etc can be provided in the marking area 15 by ink printing, water jet engraving, mechanical engraving, laser engraving, sanding, sticking, or integral casting. By this arrangement, a better bonding effect is provided for the transparent cover 2 while increasing the shift of the center of gravity of the golf club head and providing an aesthetically pleasing effect. Similar to the second embodiment, the body 1 includes a chamber 14 in a rear portion of the sole for receiving a weight member 3 for further shifting the center of gravity of the golf club head downward.

Figure 4:
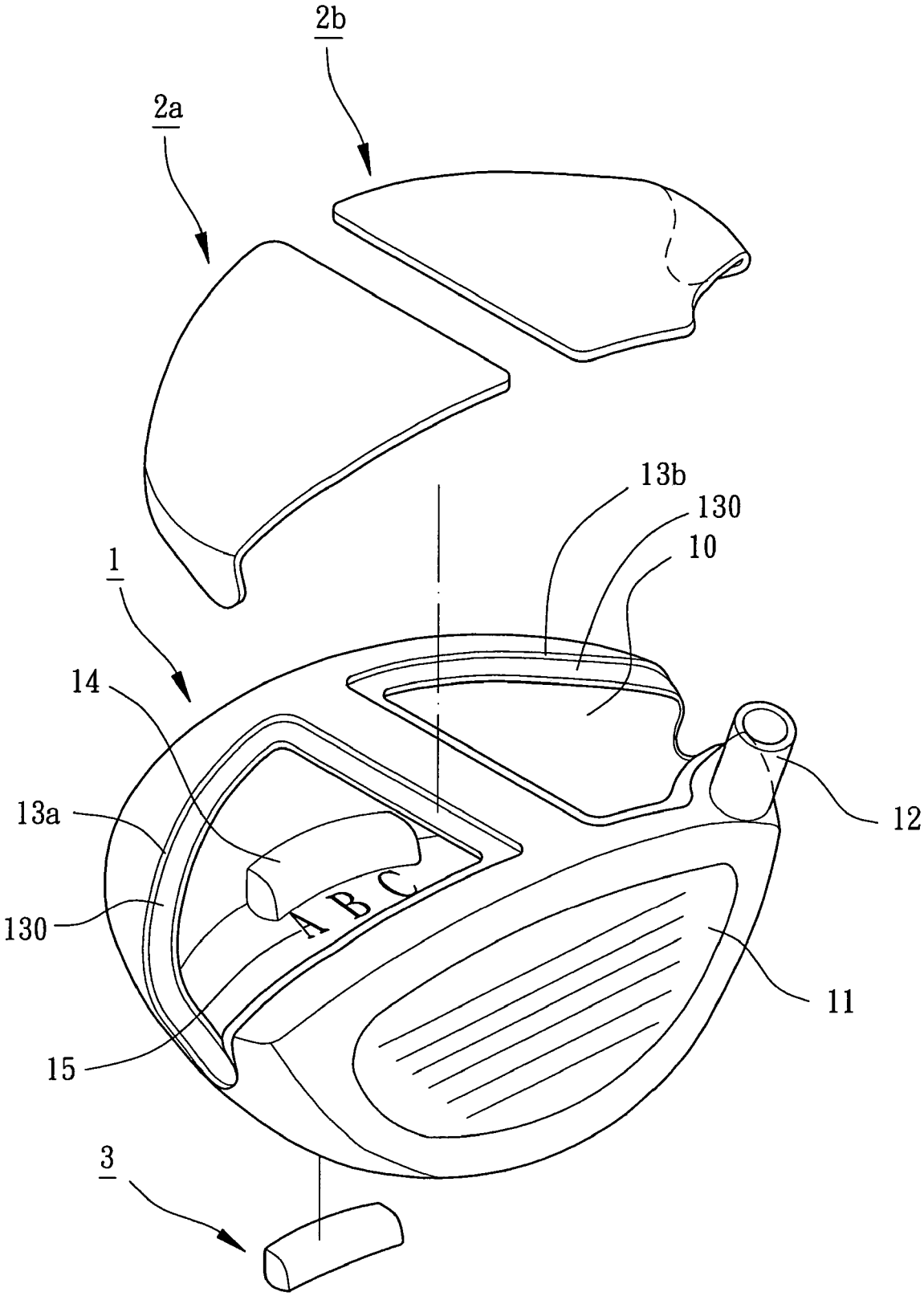
FIG. 4 is an exploded perspective view of a fourth embodiment of the golf club head in accordance with the present invention

FIG. 4 illustrates a fourth embodiment of the golf club head in accordance with the present invention, wherein the body 1 includes two openings 13*a* and 13*b* in the crown thereof. Each opening 13*a*, 13*b* includes a stepped portion 130 for engaging with a transparent cover 2*a*, 2*b*. The opening 13*a* extends from the crown toward the toe of the body 1, and the opening 13*b* extends from the crown toward the heel of the body 1. A marking area 15 is provided in an inner wall delimiting the compartment 10 of the body 1. Alternatively, the marking area 15 can be provided on an inner face of at least one of the transparent covers 2*a* and 2*b*. By this arrangement, the transparent covers 2*a* and 2*b* provide better side view angle while increasing the shift of the center of gravity of the golf club head and providing an aesthetically pleasing effect. Similar to the second embodiment, the body 1 includes a chamber 14 in a rear portion of the sole for receiving a weight member 3 for further shifting the center of gravity of the golf club head downward.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a metal body including a striking face for striking golf balls and a hosel adapted to couple with a shaft, the body including a crown, at least one opening being defined in the crown, a perimeter delimiting the opening including a stepped portion, said opening extending from the crown to a sole of the body to provide a sidewall gap; and at least one nonmetal transparent cover securely mounted to said at least one opening of the crown, said at least one transparent cover having a downward-bent extension extended from the crown to the sole, said downward-bent extension covering said sidewall gap of the body, the transparent cover being made of a transparent material having a specific gravity smaller than 1.5 g/cm3 for reducing a weight of the crown of the golf club head and for shifting a center of gravity of the golf club head downward and rearward.

2. The golf club head as claimed in claim 1, with the body further including at least one chamber in a rear portion of a sole of the body, and with at least one weight member being mounted in said at least one chamber.

3. The golf club head as claimed in claim 1, with said at least one opening extending from the crown toward a toe of the body.

4. The golf club head as claimed in claim 1, with said at least one opening extending from the crown toward a heel of the body.

5. The golf club head as claimed in claim 1, with said at least one transparent cover being made of one of crystalline engineering plastic and non-crystalline engineering plastic.

6. The golf club head as claimed in claim 5, with the transparent cover being made of a material selected from the group comprising polyetherimide (PEI), polyethersulfone (PES), polyphenylene sulfide (PPS), polyphthalamide (PPA), polyetherketone (PEK), and polyether ether ketone (PEEK).

7. The golf club head as claimed in claim 1, with the body including a compartment delimited by an inner wall, with a marking area being provided on the inner wall.

8. The golf club head as claimed in claim 7, with the marking area being formed by one of ink printing, water jet engraving, mechanical engraving, laser engraving, sanding, sticking, and integral casting.

9. The golf club head as claimed in claim 7, with the body further including at least one chamber in a rear portion of a sole of the body, and with at least one weight member being mounted in said at least one chamber.

10. The golf club head as claimed in claim 1, with said at least one transparent cover including an inner face, and with a marking area being provided on the inner face of said at least one transparent cover.

11. The golf club head as claimed in claim 10, with the marking area being formed by one of ink printing, laser engraving, sanding, sticking, and integral molding injection.

12. The golf club head as claimed in claim 10, with the body further including at least one chamber in a rear portion of a sole of the body, and with at least one weight member being mounted in said at least one chamber.

13. The golf club head as claimed in claim 1, with said at least one opening including an extension rib extending from the stepped portion.

14. The golf club head as claimed in claim 13, with a marking area being provided on an outer face of the extension rib.

15. The golf club head as claimed in claim 14, with the marking area being formed by one of ink printing, water jet engraving, mechanical engraving, laser engraving, sanding, sticking, and integral casting.

16. The golf club head as claimed in claim 13, with the body further including at least one chamber in a rear portion of a sole of the body, and with at least one weight member being mounted in said at least one chamber.

17. The golf club head as claimed in claim 1, with said at least one transparent cover having a color.

18. The golf club head as claimed in claim 1, with said at least one transparent cover being concave when viewed from an interior of the at least one transparent cover.

19. The golf club head as claimed in claim 1, with said at least one transparent cover being concave when viewed from an interior of the at least one transparent cover.

* * * * *